US008539733B2

(12) United States Patent
Bogeskov et al.

(10) Patent No.: US 8,539,733 B2
(45) Date of Patent: Sep. 24, 2013

(54) INSULATION PANEL FOR A BUILDING SYSTEM AND A METHOD AND APPARATUS FOR PRODUCING SUCH INSULATION PANEL

(75) Inventors: Henrik Bogeskov, Copenhagen (DK); Peter Hesselholt, Copenhagen (DK); Michael A. Thorsted, Brondby (DK)

(73) Assignee: Rockwool International A/S, Hedehusene (DK)

( * ) Notice: Subject to any disclaimer, the term of this patent is extended or adjusted under 35 U.S.C. 154(b) by 160 days.

(21) Appl. No.: 12/999,069

(22) PCT Filed: Jun. 15, 2009

(86) PCT No.: PCT/EP2009/057328

§ 371 (c)(1),
(2), (4) Date: Dec. 15, 2010

(87) PCT Pub. No.: WO2009/153230

PCT Pub. Date: Dec. 23, 2009

(65) Prior Publication Data

US 2011/0107721 A1 May 12, 2011

(30) Foreign Application Priority Data

Jun. 17, 2008 (EP) ..... 08158386

(51) Int. Cl.
*E04G 21/00* (2006.01)
*E04B 1/74* (2006.01)

(52) U.S. Cl.
USPC ..... 52/745.19; 52/404.1; 52/404.4; 52/591.4

(58) Field of Classification Search
USPC ..... 52/404.1, 404.2, 404.4, 586.1, 591.4, 52/745.05, 745.19
See application file for complete search history.

(56) References Cited

U.S. PATENT DOCUMENTS

| | | | | |
|---|---|---|---|---|
| 2,257,001 | A | 9/1941 | Davis | |
| 4,169,688 | A | 10/1979 | Toshio | |
| 4,170,859 | A * | 10/1979 | Counihan | 52/779 |
| 4,228,624 | A * | 10/1980 | Reneault et al. | 52/145 |
| 4,682,458 | A * | 7/1987 | Sparrow | 52/309.8 |
| 5,062,250 | A | 11/1991 | Buzzella | |
| 5,992,112 | A * | 11/1999 | Josey | 52/309.8 |
| 6,620,487 | B1 * | 9/2003 | Tonyan et al. | 428/192 |
| 6,941,720 | B2 * | 9/2005 | DeFord et al. | 52/783.14 |
| 2003/0046892 | A1 | 3/2003 | Albany et al. | |

FOREIGN PATENT DOCUMENTS

| | | | |
|---|---|---|---|
| DE | 79 32 271 | U1 | 4/1980 |
| DE | 20110293 | U1 | 9/2002 |
| EP | 1479825 | A1 | 11/2004 |

(Continued)

*Primary Examiner* — William Gilbert
*Assistant Examiner* — Patrick Maestri
(74) *Attorney, Agent, or Firm* — Gifford, Krass, Sprinkle, Anderson & Citkowski, P.C.

(57) ABSTRACT

The present invention concerns an insulation panel for fitting between profiles in a framework of an insulating building system for an external building structure, such as a wall or a roof, or an internal building structure, such as a partitioning wall or a ceiling or floor structure, said panel comprising substantially parallel first and second main surfaces with substantially parallel, oppositely situated first and second profile contact sides and substantially parallel, oppositely situated third and fourth sides between said main surfaces. In addition, the invention concerns a method of producing insulation panels and an apparatus for producing insulation panels according to the method.

12 Claims, 5 Drawing Sheets

(56) References Cited

FOREIGN PATENT DOCUMENTS

| | | | |
|---|---|---|---|
| EP | 0 896 106 | B2 | 9/2005 |
| WO | 01/71119 | A1 | 9/2001 |
| WO | 2006086228 | A3 | 12/2006 |
| WO | 2007085260 | A1 | 8/2007 |

* cited by examiner 3
3
2
1
d
d
2
2
1
3
3
2
4

INSULATION PANEL FOR A BUILDING SYSTEM AND A METHOD AND APPARATUS FOR PRODUCING SUCH INSULATION PANEL

CROSS-REFERENCE TO RELATED APPLICATIONS

This application is the U.S. national phase of PCT/EP2009/057328 filed Jun. 15, 2009, which claims priority of European Patent Application No. 08158386.6 filed Jun. 17, 2008.

FIELD OF THE INVENTION

The present invention relates to an insulation panel for a building system and a method and an apparatus for producing such insulation panel.

BACKGROUND OF THE INVENTION

In WO 00/26483 a method and a profile for connecting building blocks is described resulting in a wall in a building system. According to this method, two construction blocks are joined along an edge face of each block abutting each other by a profile having a web and two flanges on each side with a perpendicularly extending flap at the distal ends of these two flanges. These flaps are inserted into a groove in the construction blocks whereby the blocks are held together.

This method is advantageous since prefabricated construction blocks may be provided off site and transported to the building site together with other materials and may be assembled on the building site. However, if the rectangular frame is subjected to a twisting force, the gripping flanges may slide out of the slits in the insulation making the entire building system unstable.

SUMMARY OF THE INVENTION

By the present invention it is realised that a building structure may be provided utilising this connecting method for both internal as well as external building structures.

Accordingly, in one aspect of the invention, there is provided an insulation panel for fitting between joining profiles, such as I- or H-profiles, in a framework of an insulating building system for an external building structure, such as a wall or a roof, or an internal building structure, such as a wall or a ceiling or floor structure, said panel comprising substantially parallel first and second main surfaces with substantially parallel, oppositely situated first and second profile contact sides and substantially parallel, oppositely situated third and fourth sides between said main surfaces, characterised in that said first and second profile contact sides are provided with a longitudinal slit substantially parallel to the first main surface in a predetermined distance therefrom so that said first and second profile contact sides are provided with a profile abutment portion and a profile covering portion.

Preferably the profile covering portion of the insulation panel extends beyond the abutment portion of at least one of the side edges of the insulation panel. In a second embodiment of the insulation panel, the profile covering portion of the side of the insulation panel comprises a flex zone, at least in the portion extending beyond the abutment portion.

A flex zone/flexible zone is a portion of an insulation panel made less rigid during the manufacture, e.g. by pressing rollers into the zone and moving them along the edge. This has the advantage that this zone is compressible and may be compressed in order to provide a tight panel-panel junction or in order to fit between the rafters and beams of a building structure. Further, the need for different formats of panels is reduced by using a flexible zone comprising a flexible section along one side of the insulation panel.

Preferably, the at least one flex zone is provided by softening the respective side by compressing or stretching the edge portion during manufacture and thereby reducing the fibre bonding in the flexible section. Hereby, the fibre bondings are broken making the fibrous insulation element flexible without reducing the density and without significantly influencing the thermal insulation properties.

The insulation panel may be used for a self-supporting system for an internal or external wall, floor, ceiling or roof in a building structure. In a vertically arranged building structure according to the invention, it is found that by providing the preformed insulation panels between the joining profiles, the joining profiles are prevented from buckling due to the compression load, since the insulation panels are not only retained at the first set of opposite sides abutting the adjacent joining profiles but are also retained by the frame profiles at the other peripheral sides. By a system according to the invention, the form stability in the insulation panel, such as mineral fibrous insulation material, is utilised to prevent displacement in the building structure.

By the invention, it is realized that a fast installation time on the building site may be achieved. Moreover, it is a cost-effective and simple solution with a high degree of flexibility, as the system according to the invention may be used for different building applications.

The insulation panels are preferably made of a mineral fibre wool material with a density between 30-150 kg/m$^3$, preferably 50-125 kg/m$^3$ and most preferably 60-100 kg/m$^3$. Mineral fibre wool panels, such as stone wool fibre panels, are advantageous since a non-combustible building system is thereby provided. However, it is realised that other materials could be used, such as polystyrene foam or the like.

By the present invention, it is found that the insulation panels may have a total thickness ranging from 75 mm to 500 mm. Hereby also modern insulation requirements for domestic housings can be met by a building system according to the invention. In one embodiment, each insulation panel consists of one insulation slab. However, the invention may in one embodiment be used with an arrangement of double or multiple layers of insulation slabs, e.g. each insulation panel may comprise two or more insulation slabs provided in a stacked and/or layered configuration, whereby the total thickness of the insulation panel becomes roughly the sum of the thicknesses of the provided insulation slabs, which is suitable in particular for large thicknesses of insulation. Further, for large thicknesses of insulation, the profile may comprise fixing means, like claws or clamps, that may be bent out from the body portion of the profile to secure the different insulation layers.

In one embodiment of the invention, the insulation panel may have a dual density structure so that the density of the insulation panel between the profile covering portions of the two contact sides is higher than the density of the insulation panel between the profile abutment portions of the two contact sides. Further, an insulation panel may have a compression elasticity modulus of at least 500 kPa, preferably when measured parallel to the width of an insulation panel.

The compression elasticity modulus, E, is preferably calculated according to the European Standard EN 826: 1996, which concerns thermal insulating materials and products for building applications. According to the standard, section 8.3, the compression elasticity modulus, E, is calculated in kPa using the formula E=sigma*(d0/Xe) with sigma=(10^3)*(Fe/

A0) where Fe is the force at the end of the conventional elastic zone (distinct straight portion of the force-displacement curve), in newtons; Xe is the displacement at Fe in millimeters; A0 is the initial cross-sectional area of the specimen, in square millimeters, and d0 is the initial thickness (as measured) of the specimen, in millimeters.

In one embodiment of the insulation panels, at least the profile abutment portions of the contact sides are provided with an adhesive layer for adhering to the profile. In one embodiment, the provided adhesive layer comprises gluing. Providing an adhesive layer may yield extra strength against shearing forces, may prevent bending of the insulation panels or the joining profiles, and may promote internal bracing and stability. Further, the insulation panels may be provided with slits in top and/or bottom side edges for receiving a flange of top and/or bottom frame profiles in the building structure for retention of the insulation panel therein.

Preferably, the side surfaces of the profiles and the corresponding contact surfaces on the insulation panels are shaped such that an insulation panel retaining is provided. In particular, the joining profiles are advantageously provided with retention profile members at both the first and second side of the partitioning assembly and preferably at least one of retention profile members of the profiles is adapted for subsequent mounting.

In a preferred embodiment, the profiles are parallelly mounted with a mutual distance ranging from 400 mm to 1800 mm, preferably 500-1500 mm, more preferably 900-1200 mm. Hereby, the thermal conductivity of the building structure is significantly reduced. It is found possible to provide this extra wide distance between column profiles in a wall structure (which is usually approx. 600 mm) since the insulation provides for a self-supporting wall structure. If extra load bearing strength is need, it is of course realised that profiles may be parallelly mounted with a mutual distance of 400 to 800 mm. This could be advantageous for instance in relation to floor or roof constructions. By the invention it is also realised that the usual smaller distance between the profiles, e.g. between 400-700 mm, more preferably 450-600 mm, could be retained and instead thinner joining profiles are provided thereby also reducing the thermal conductivity. This becomes advantageous since the thin joining profiles are supported by the insulation panels.

Preferably, a first cover structure is provided on the first side of the assembly, and a second cover structure on said second side thereof.

In one embodiment, the first cover structure is a sheet cover, such as a plywood or gypsum sheet cover structure. In another embodiment, the second cover structure may be a climate shield cover, such as an insulated outer wall system. Hereby, a low energy solution having high thermal insulation properties is provided when using the system according to the invention for an external building structure.

In a second aspect of the invention, there is provided a method of producing an insulation panel, said method comprising the steps of: providing an insulation panel having substantially parallel first and second main surfaces with substantially parallel, oppositely situated first and second profile contact sides and substantially parallel, oppositely situated third and fourth sides between said main surfaces; providing a slit along the first contact side in a predetermined distance from the first main surface and substantially parallel with said first main surface, so that said contact side is provided with a profile abutment portion and a profile covering portion; removing material from the abutment portion of said contact side so that the profile covering portion extends beyond the abutment portion of the contact side, and manipulating said extending profile covering portion to provide a flex zone in said profile covering portion of the first contact side.

In one embodiment of the method, the steps are repeated for at least the second contact side of said insulation panel and preferably also for the third and the fourth contact sides thereof. Further, the steps may be carried out substantially at the same time or the steps may be carried out sequentially.

In a third aspect of the invention, there is provided an apparatus for performing any of the above-mentioned methods, said apparatus comprising a substantially planar work surface with a substantially perpendicular guiding flange for receiving an insulation panel which is slideable on said surface along said guiding flange with an insulation panel side in contact with said flange; first means, such as cutting or grinding means, for providing a slit in the side of the insulation panel, said means being provided at the guiding flange; second means, such as cutting or grinding means, for removing insulation material from the abutment portion of the contact side of the insulation panel; and manipulation means for compressing the extending profile covering portion to provide a flex zone in said profile covering portion of the first contact side in said insulation panel.

In one embodiment of the apparatus, the first means comprise a rotating cutting blade provided substantially parallel to the work surface in a predetermined distance from the surface. Further, the second means may comprise a grinding tool for the removal of material from the side edge of the insulation panel, the manipulating means may comprise a compression roller or a knife drum, and the first means, the second means and the manipulating means may be arranged with common drive means, such as a common drive shaft. In one embodiment, all the means are driven together.

BRIEF DESCRIPTION OF THE INVENTION

The invention is further explained in the following under reference to the accompanying drawings in which.

DETAILED DESCRIPTION OF THE INVENTION

Figures 1, 2:
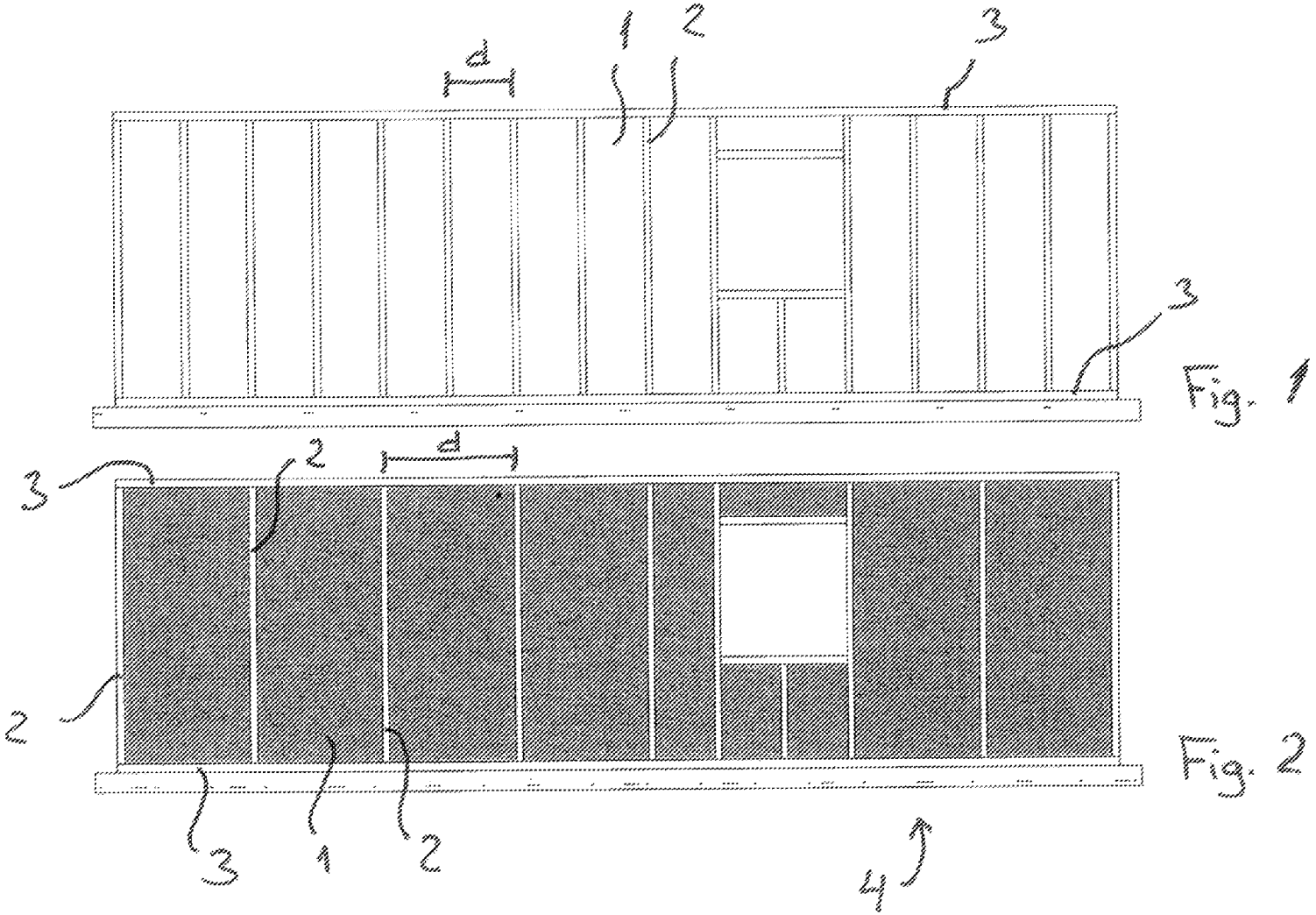
FIG. 1 is a schematic view of a partition wall according to prior art.
FIG. 2 is a schematic view of a partition wall according to the invention.

With reference to FIGS. 1 and 2, the internal portioning structure 4 of an insulating building partitioning wall may be made by assembling a number of insulation panels 1 with joining profiles 2 and framing the assembled panels 1 in top and bottom frame profiles 3. The joining profiles 2 are provided with a distance d apart. In FIG. 1, this distance is approx. 600 mm whereas in FIG. 2, the distance d may be 900 to 1200 mm. The frame profiles 3 are preferably U-shaped profiles with a cavity for receiving the insulation therein.

Figure 3:
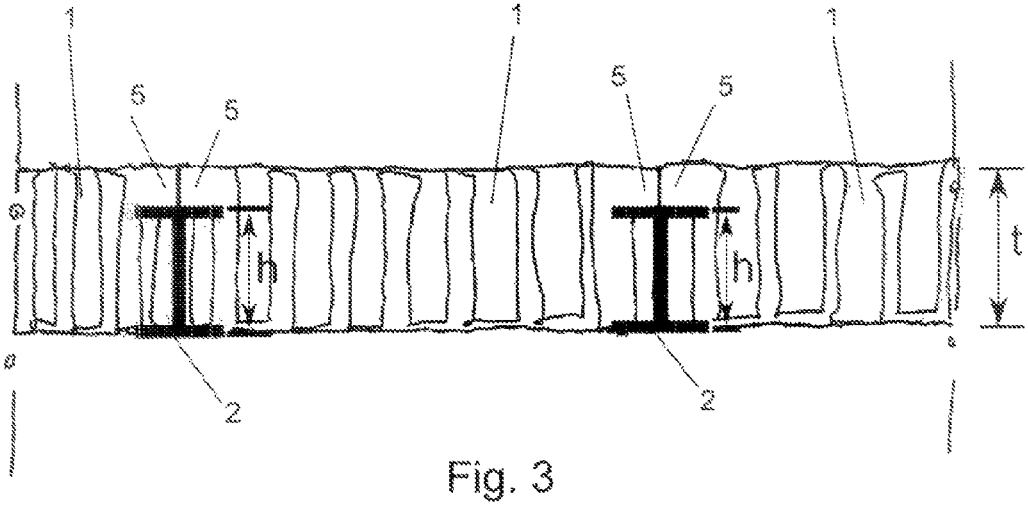
FIG. 3 is a schematic horizontal cross section view of joining profiles with mounted insulation panels.

With reference to FIG. 3, joining profiles 2 are mounted with insulation panels 1. The insulation panels 1 have flex zones 5 by which tight panel-panel junctions are achieved next to the joining profiles 2. A tight panel-panel junction may reduce thermal bridging and acoustic bridging. Reduction of thermal bridging may reduce heat dissipation and may protect the profiles in case of fires or the like. In addition, a tight junction may support a stiffening external cladding or bracing. In the embodiment shown, the total thickness t of the insulation panels is larger than the height of the joining profiles.

Figure 4:
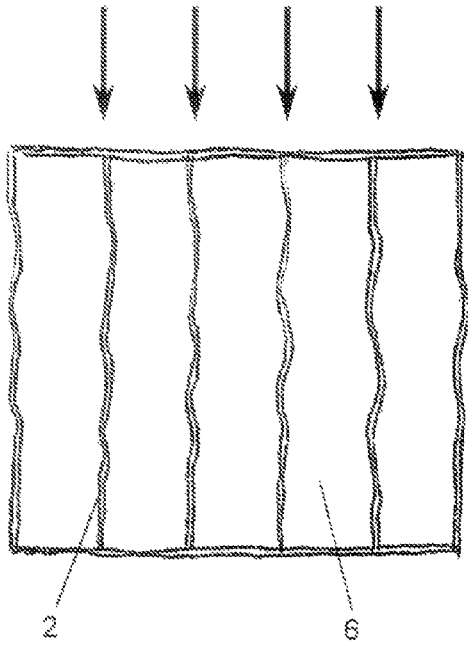
FIG. 4-5 are schematic vertical cross section views of insulating building systems.
Figure 5:
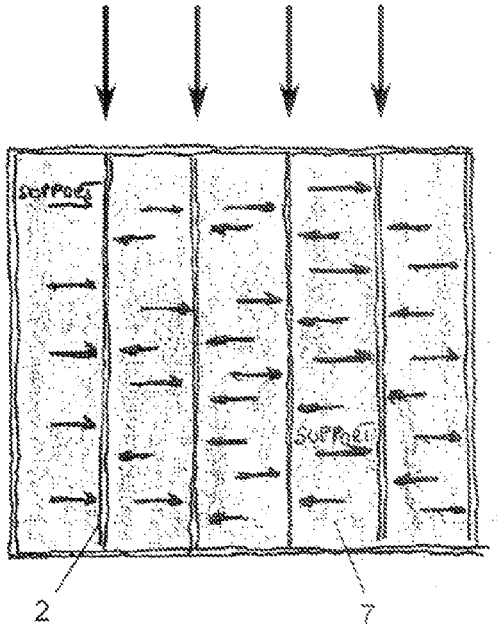

With reference to FIGS. 4 and 5, joining profiles 2 mounted with insulation panels, subjected to a top-down force represented in the figures by vertical arrows, are shown in a vertical cross section view. A building system having low wool density insulation panels 9 is shown in FIG. 4. Since the wool density is low, the joining profiles are susceptible to bending. In FIG. 5 is shown a building system having high wool density insulation panels 10. Because of the high wool density, stronger lateral forces support the joining profiles 2 such that the joining profiles 2 are less susceptible to bending.

Figure 6:
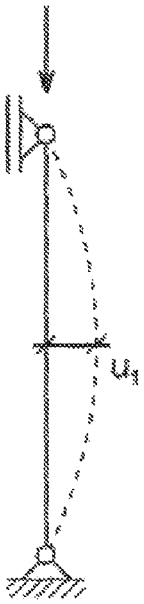
FIG. 6-7 are illustrations of bending with and without lateral support.
Figure 7:
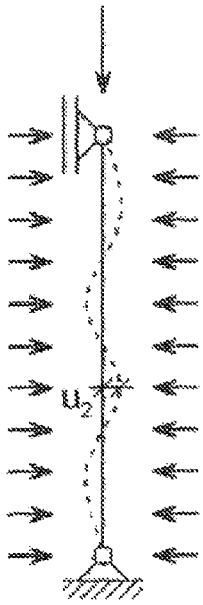

With reference to FIGS. 6 and 7, bending of a joining profile caused by a top-down force is shown in conceptual illustrations. The bending amplitude u2 of the joining profile in FIG. 7 is smaller than the bending amplitude u1 of the joining profile in FIG. 6 because the joining profile in FIG. 7 is stabilized by lateral forces. In addition, the buckling length is smaller when a joining profile is stabilized by lateral forces.

Figure 8:
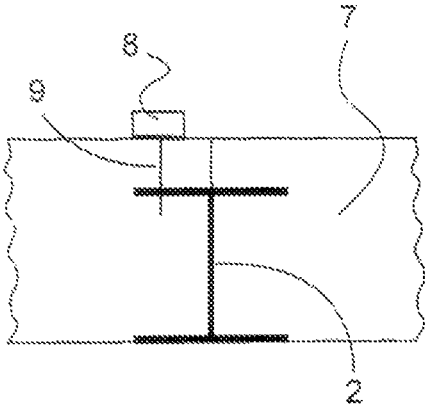
FIG. 8-9 are schematic horizontal cross section views of insulating building systems supporting outer building elements.
Figure 9:
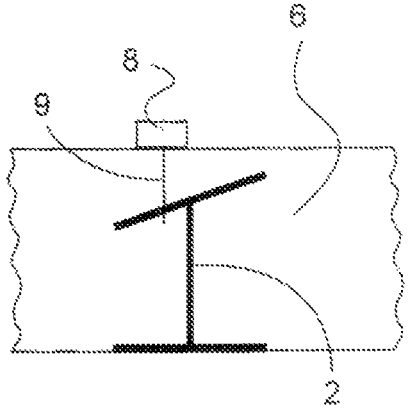

With reference to FIGS. 8 and 9, there are shown horizontal cross section views of an insulating building system with high wool density insulation panels 7 in FIG. 8, and a corresponding building system with low wool density insulation panels 6 in FIG. 9. A joining profile 2 in a high wool density building system may support an additional building element 8 for instance by nail 9 or screwing engagement without bending, whereas a joining profile in a low wool density building system is prone to bending when support of an additional building element is pursued because low wool density insulation panels 6 provide less support for joining profiles compared to the support provided by high wool density insulation panels 7.

Figure 10:
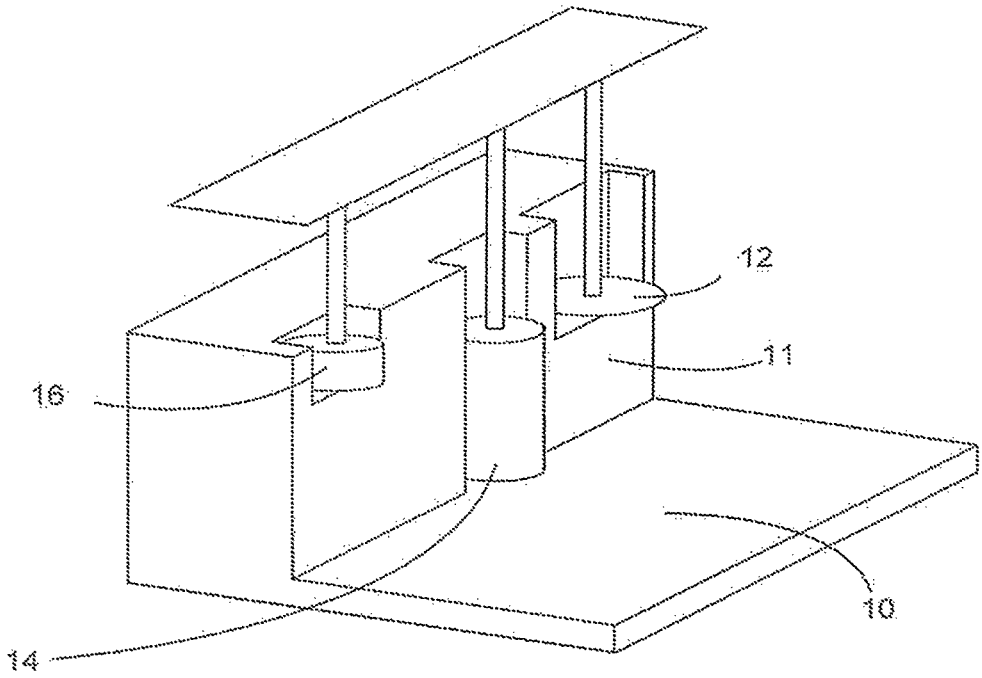
FIG. 10 is a schematic perspective view of an apparatus for producing an insulation panel.
Figure 11:
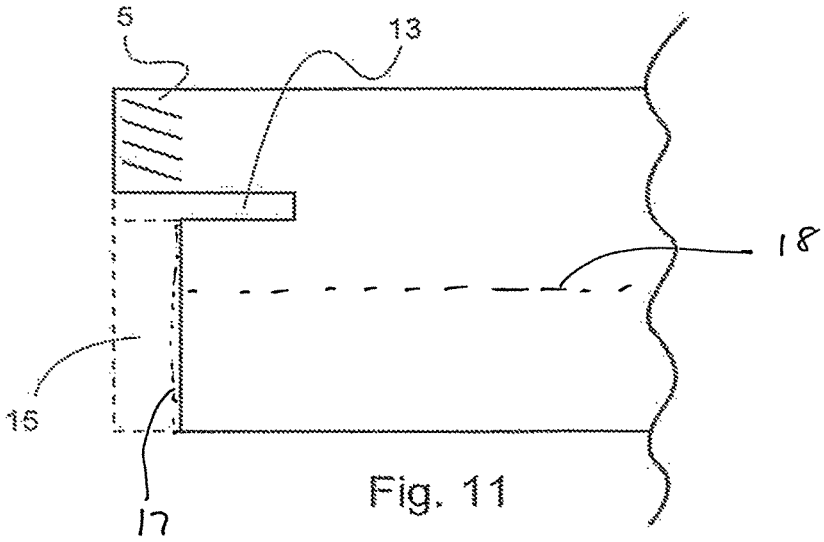
FIG. 11 is a schematic cross section view of the edge detail of an insulation panel.

With reference to FIGS. 10 and 11, there is shown a schematic view of an embodiment of an apparatus for producing insulation panels and an edge detail of an insulation panel produced by such an apparatus. The apparatus, see FIG. 10, has a planar work surface 10 and a guiding flange 11 for receiving an insulation panel, which is slideable on the surface 10 along the guiding flange 11. The apparatus is provided with a first means 12, such as a rotating cutting blade or a circular saw, for providing a slit 13 in the side of the insulation panel, which slit may fit with a portion of a flange of a joining profile. The slit 13 may also represent a slit in the third or fourth sides of the insulation panel for receiving a flange of a top or bottom frame profile. Further, there is provided a second cutting means 14, such as a grinding tool for removing material 15 from the insulation panel. For instance, insulation material may be removed from the abutment portion of the contact side of the insulation panel. Furthermore, there is provided a manipulation means 16, such as a compression roller or a knife drum, for compressing or extending a profile covering portion to provide a flex zone 5 in said portion. In one embodiment, the apparatus is adapted for modification of standard sized insulation panels in order to fabricate modified insulation panels having specific dimensions so that the modified insulation panels may fit into specific building structures. This may prove advantageous at the construction site whereto standard sized insulation panels are easily delivered. As discussed above, in some embodiments at least the profile abutment portions of the contact sides are provided with an adhesive layer for adhering to the profile. Such an adhesive layer is represented at 17. Also as discussed above, in some embodiments each insulation panel may comprise two or more insulation slabs provided in a stacked and/or layered configuration. Line 18 indicates a dividing line that may represent where two stacked slabs mean to form an insulation panel.

Above, some embodiments currently considered advantageous are described. However, by the invention it is realised that other advantageous embodiments may be provided without departing from the scope of the invention as set forth in the accompanying claims. For instance, any of the structures shown in the embodiments above may be used with different orientations, vertically, horizontally or inclined, and may also be used as either internal or external partitioning building structures in a building.

The invention claimed is:

1. A method of producing an insulation panel configured to be fitted between joining profiles in a framework of an insulating building system, wherein the insulation panel is a mineral fiber wool panel, said method comprising the steps of:

providing an insulation panel made of mineral fiber wool material with a density in the range of 60 to 100 kg/m$^3$, the insulation panel having substantially parallel first and second main surfaces with substantially parallel, oppositely situated first and second profile contact sides and substantially parallel, oppositely situated third and fourth sides between said main surfaces;

providing a groove along the first and second contact sides at a predetermined distance from the first main surface and substantially parallel with said first main surface, whereby said contact sides are divided into a profile abutment portion and a profile covering portion;

removing material from the abutment portion of said contact sides so that each profile covering portion extends beyond the abutment portion of the contact side; and manipulating each said extending profile covering portion to provide a flex zone that is softer and more flexible than the remainder of the panel by reducing the fiber bonding in the flex zone, so as to provide a tight panel-to-panel fit and improved thermal insulation when a panel is joined to another panel in said profile covering portion of the first contact side.

2. A method according to claim 1, wherein the steps are carried out substantially at the same time or wherein the steps are carried out sequentially.

3. An insulation panel configured to be fitted between joining profiles in a framework of an insulating building system, wherein said insulation panel is a mineral fiber wool panel, said insulation panel comprising:

substantially parallel first and second main surfaces having substantially parallel, oppositely situated, first and second profile contact sides and substantially parallel, oppositely situated, third and fourth sides between said main surfaces, wherein said first and second profile contact sides are provided with a groove substantially parallel to the first main surface in a predetermined distance therefrom whereby said first and second profile contact sides are divided into a profile abutment portion and a profile covering portion;

wherein the profile covering portion of the side of the insulation panel comprises a flex zone in at least the profile covering portion extending beyond the profile abutment portion whereby said profile covering portion is made softer and more flexible than the remainder of the panel by reducing fiber bonding in the flex zone, so as to provide a tight panel-to-panel fit and improved thermal insulation when it is joined to another panel; and wherein the insulation panel is made of mineral fiber wool material with a density in the range of 60 to 100 kg/m$^3$.

4. An insulation panel according to claim 3, wherein the profile covering portion extends beyond the abutment portion of at least one of the side edges of the insulation panel.

5. An insulation panel according to claim 3, wherein the insulation panel is made of a mineral fibre wool material with a density between 30-150 kg/m$^3$.

6. An insulation panel according to claim 3, wherein the insulation panel is provided with a dual density structure so that the density of the insulation panel between the profile covering portions of the two contact sides is higher than the density of the insulation panel between the profile abutment portions of the two contact sides.

7. An insulation panel according to claim 3, wherein the insulation panel has a compression elasticity modulus of at least 500 kPa, preferably when measured parallel to the width of said insulation panel.

8. An insulation panel according to claim 3, wherein the insulation panel has a total thickness between 75 and 500 mm.

9. An insulation panel according to claim 3, wherein at least the profile abutment portions of the contact sides are provided with an adhesive layer for adhering to the profile.

10. An insulation panel according to claim 3, wherein there is also provided at least one slit in said oppositely situated third and fourth sides for receiving a flange of top and/or bottom frame profiles in the building structure for retention of the insulation panel therein.

11. An insulation panel according to claim 3, wherein each insulation panel consists of one insulation slab.

12. An insulation panel according to claim 3, wherein each insulation panel comprises two or more insulation slabs provided in a stacked and/or layered configuration.

* * * * *

UNITED STATES PATENT AND TRADEMARK OFFICE

CERTIFICATE OF CORRECTION

PATENT NO. : 8,539,733 B2
APPLICATION NO. : 12/999069
DATED : September 24, 2013
INVENTOR(S) : Henrik Bogeskov et al.

It is certified that error appears in the above-identified patent and that said Letters Patent is hereby corrected as shown below:

In the Claims:

At column 6, claim number 1, line number 40, after panel, Delete "in said profile covering portion of the first contact side".

Signed and Sealed this
Fourteenth Day of October, 2014

Michelle K. Lee

Michelle K. Lee
*Deputy Director of the United States Patent and Trademark Office*